US005228805A

United States Patent [19]

Chang

[11] Patent Number: 5,228,805

[45] Date of Patent: Jul. 20, 1993

[54] WATER PRESSURE REDUCING STRUCTURE OF A RAFT FOUNDATION BOTTOM PLATE

[76] Inventor: Jeffery Chang, No. 91-1, Tung An Street, Taipei, Taiwan

[21] Appl. No.: 856,086

[22] Filed: Mar. 19, 1992

[51] Int. Cl.[5] ..... E02D 5/00

[52] U.S. Cl. ..... 405/229; 405/36; 52/1; 52/169.5

[58] Field of Search ..... 405/229, 230, 244, 248, 405/200, 210, 270, 38, 36; 52/1, 2.22, 2.23, 167 R, 169.5

[56] References Cited

U.S. PATENT DOCUMENTS

| | | | |
|---|---|---|---|
| 4,222,206 | 9/1980 | Kitamura | 405/229 X |
| 4,273,475 | 6/1981 | Fuller | 405/229 |
| 4,704,052 | 11/1987 | Aubert | 405/229 |
| 4,995,764 | 2/1991 | Connery et al. | 405/229 |
| 5,017,046 | 5/1991 | Sugimoto et al. | 405/229 |
| 5,120,162 | 6/1992 | Parker | 405/229 |

*Primary Examiner*—Dennis L. Taylor
*Assistant Examiner*—J. Russell McBee
*Attorney, Agent, or Firm*—Pro-Techtor International

[57] ABSTRACT

A specific structure of construction to be implemented at the bottom part of a raft foundation to reduce the upward water pressure of the raft foundation bottom or to control the water pressure. An artificial drainage bed structure is constructed at the raft foundation bottom plate, comprising an artificial filter layer, artificial drainage latticed network, water filter/collecting pipe, non-permeable fabric, overflow drain pipe and other elements to reduce and control the impact of a floating force or an excessively large water pressure on the raft foundation bottom plate which is likely to occur during the course of construction.

1 Claim, 7 Drawing Sheets

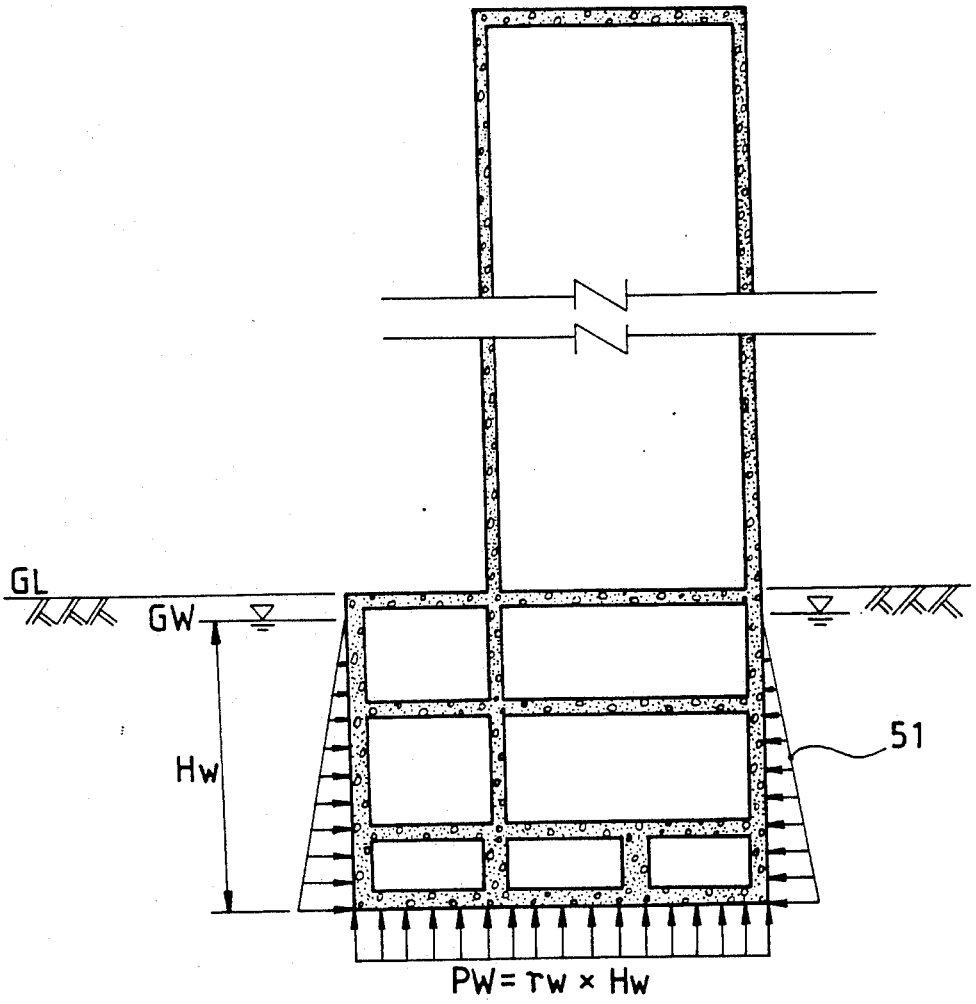
FIG.5-A

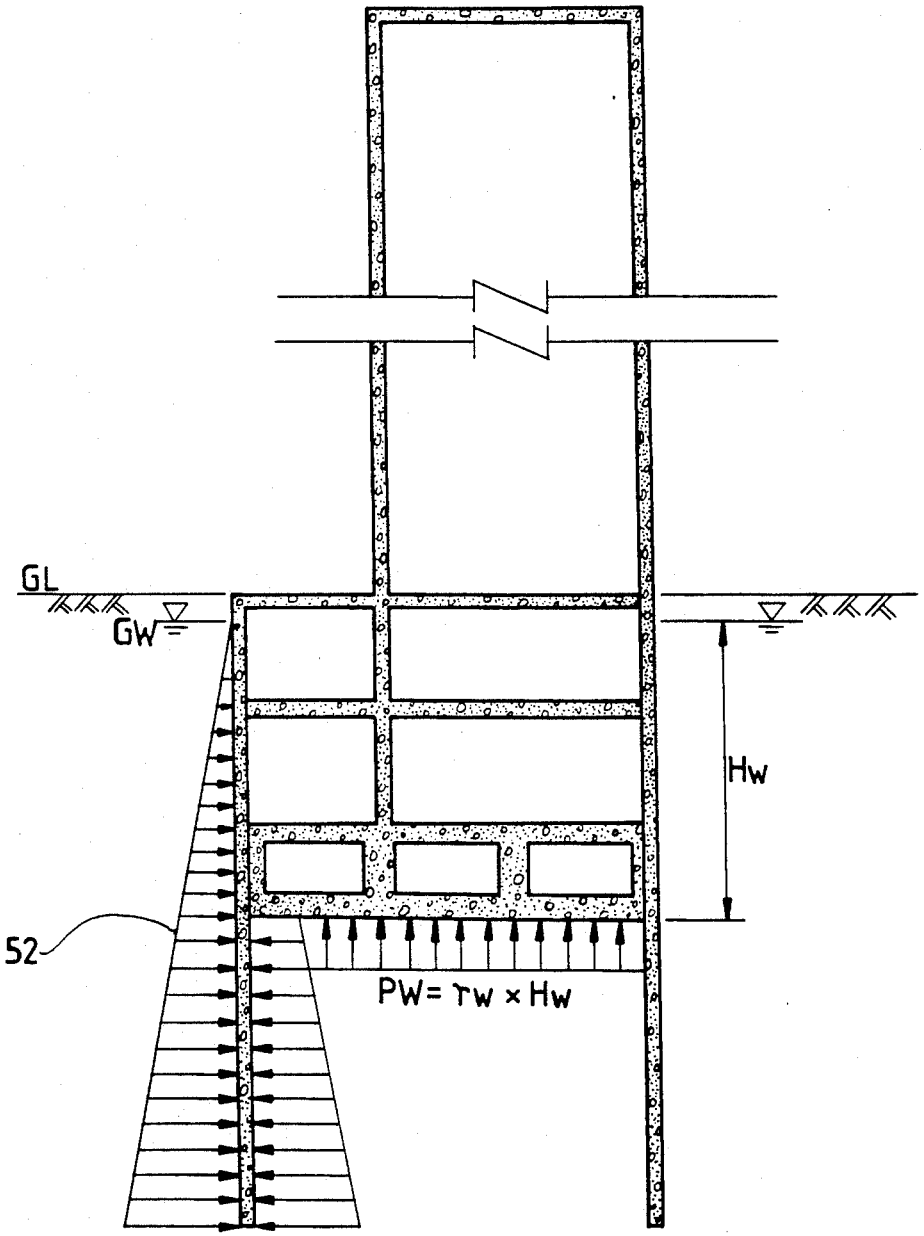
FIG. 5-B

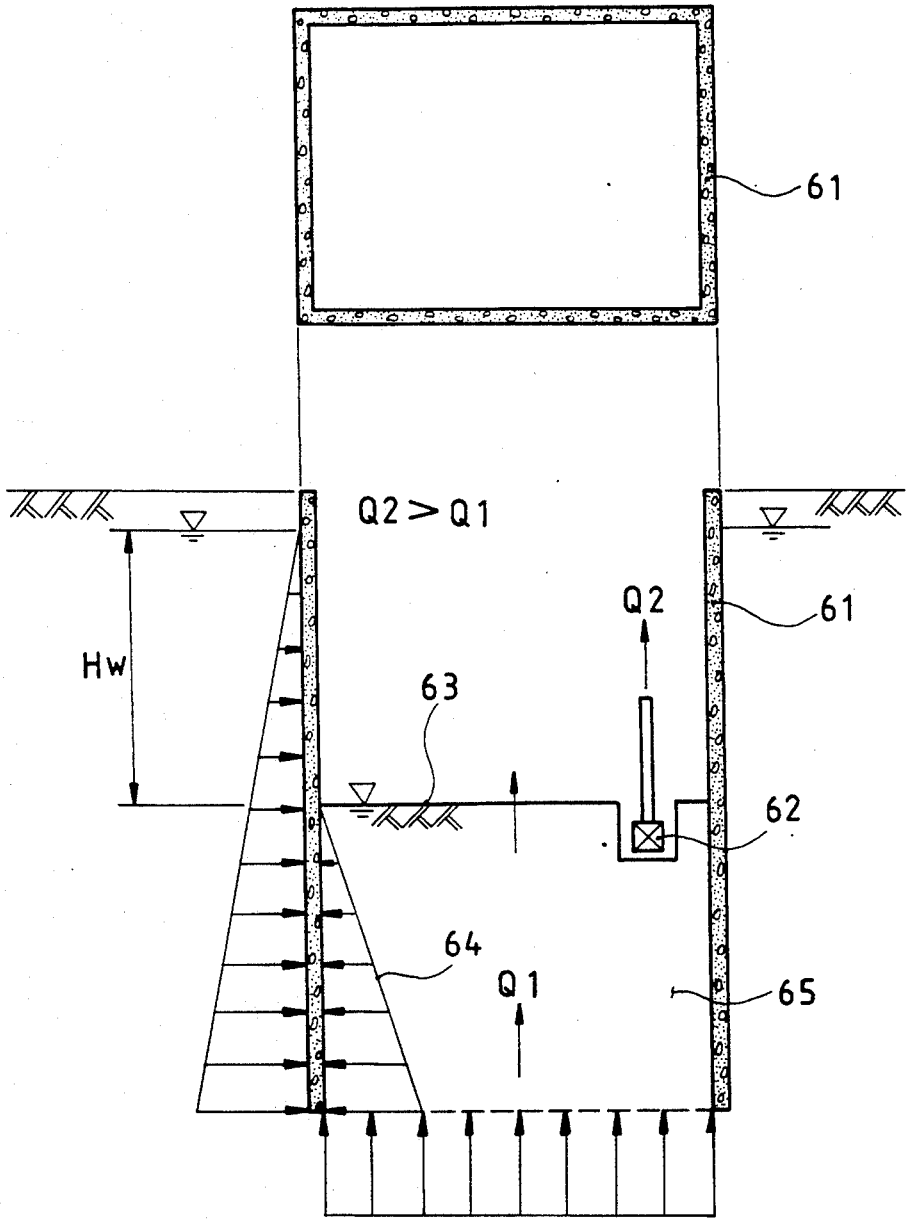
FIG. 6-A

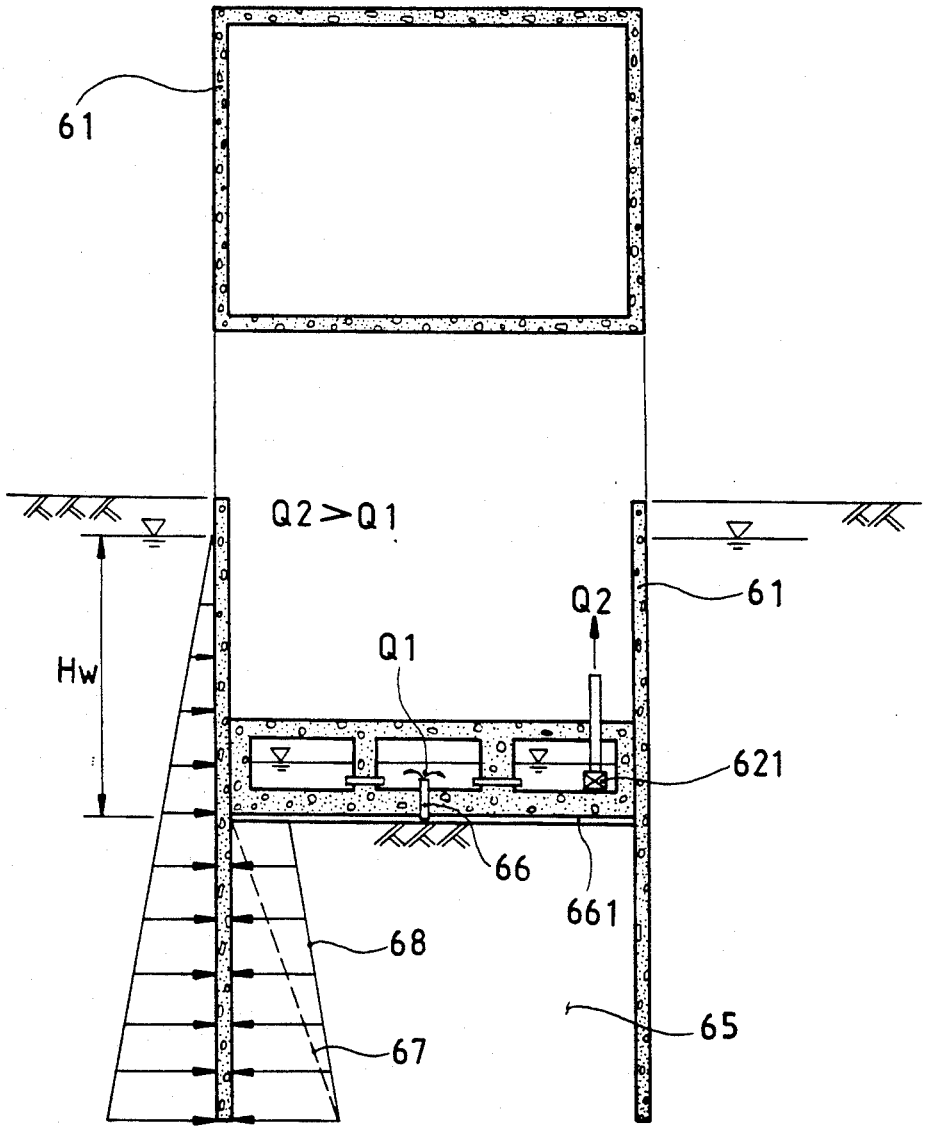
FIG. 6-B

WATER PRESSURE REDUCING STRUCTURE OF A RAFT FOUNDATION BOTTOM PLATE

FIELD OF THE INVENTION

The present invention is related generally to the structure of a raft foundation bottom plate in a building, and more particularly to a raft foundation structured so as to reduce and control the water pressure on its lower surface.

BACKGROUND OF THE INVENTION

Owing to the rapid industrial and commercial development of urban areas in recent history, there is commonly inadequate space in cities for new construction. In order to maximize basement space, a hollow type of deep raft foundation is usually employed in new buildings. The depth to which the basement area is dug ranges from GL-12.0 meters to GL-30.00 meters, and may even exceed that depth. However, as the water table in a city is generally higher than in a rural area, if the area of a structure projecting above the ground is not significantly greater than the area of a foundation which has been dug, the weight of the structure may not be sufficient to stabilize the floating force produced by the underground water level. Such a structural design may cause the following problems to the raft foundation:

(1) A part of the raft foundation may be controlled by an uplift floating force (the weight of the structural body is lighter than the floating force produced). This will cause the bottom part of the foundation to be more easily separated from the soil, causing the foundation to "float" upward. This uplifting force may cause a break in the foundation from the large moment and shear to which the foundation would be subjected from such motion.

(2) The part of raft foundation which is being affected by the floating force may be displaced upward, while the remainder of the foundation may start to "sink", again creating the problem of breakage in the foundation.

SUMMARY OF THE INVENTION

Technical Principles (1) Formation of the floating force

When an excavation is made for a foundation, the surface of the excavated area will be subject to water pressure due to the fact that it will usually be lower than the water table. Due to the porosity of the bottom of the foundation (as indicated per FIGS. 5-A, 5-B) water will seep into it for some time. When the water pressure of the bottom part of foundation is equilibrated with the long-term underground water level, the floating force to be received by the bottom part of the foundation will be:

$$P_w = {}_w H_w$$

(2) The time factor required to form the floating force

The soil is formed from various materials having porous coefficients in the range $K=10^0$–$10^{-9}$ cm/sec. At the time of construction, the pressure at the bottom part of the foundation is very small as water is being pumped away from the site. However, upon completion of the foundation, the concrete at the foundation will form a non-permeable structure. At this time the pressure at the bottom part of the raft foundation is smaller than that of the standing water. The underground water, being at a comparatively higher water level in the exterior, will tend to flow by seeping into the foundation where the pressure is lower. This function will continue until the pressures become equilibrated.

The time required to reach an equilibrium is mainly determined by the coefficient of water permeability of the soil. In a gravel layer or coarse sandy layer, in which the coefficient of water permeability is $K=10^0$–$10^{-3}$ cm/sec, the difference of pressure found between the two points will be equilibrated within a few hours or days. However, in the case of clay or clay sinking mud, in which the coefficient is $K=10^{-5}$–$10^{-8}$ cm/sec, when i=1, i denoting the sloping reduction of the water force, and l being the depth of the continuous foundation wall, and $i=H_w/l$, the seeping rates (V) of various stratum of earth are as follows:

$K=10^{-5}$ cm/sec, V=315.5 cm/year $K=10^{-6}$ cm/sec, V=31.6 cm/year $K=10^{-7}$ cm/sec, V=3.16 cm/year $K=10^{-8}$ cm/sec, V=0.3 cm/year It will generally take from one to ten years to reach equilibrium.

(3) Method to eliminate the floating force

A. A clay bed or bed-shaped low permeability layer

By making use of the various special functions of permeability of the strata of earth, one may first build a non-permeable continual wall to close the foundation completely by pressing a non-permeable tube-shaped article into a layer of soil which is of a low water permeability. Remove part of the soil and reduce the water level. In so doing, a difference of pressure will be found between the digging plane inside the continual wall and the external underground water level (as indicated in FIGS. 6-A, 6-B).

In this way, the underground water will flow inward from the opening at the bottom part of the continuous foundation wall. Owing to the low water permeability of the soil layer, the seeping and flowing of the water will be blocked, and thus will further enable the underground water to flow upward at a very low speed. Therefore, the volume of the water which is seeping will become very small, and the rising speed of the water level within the continuous foundation wall will also be very slow. When the daily pumping volume is greater than the volume of water which flows into the excavation area, the water level within the excavation will not rise.

When a bed for a non-permeable raft type of foundation plate is built on the excavation area, the water which had been seeping will then be blocked. It will, for a long period of time, form a water pressure underneath the raft type of foundation plate until this water pressure becomes equal to that of the ground water surrounding the foundation plate. If the water pressure becomes too large, it will be rather unfavorable to the stability of the foundation.

In order to make use of the special function of non-permeability of a clay bed stratum of earth, a permeable bed (including a construction filter layer, a drainage latticed network bed, and non-permeable PVC fabric) will also be utilized.

Water will be drained through a drainage pipe network system into the foundation tank to be further discharged by a pump. So long as the capacity of discharging the underground water at the bottom plate of the raft foundation is far greater than the underground water seepage rate into the bottom plate of the raft foundation, the bottom plate of the raft foundation will not be subjected to any water pressure.

B. A rock bed or hard soil stratum

Similar to the principle described in paragraph A above, the low permeability of a rock bed or hard soil stratum can be used to enable the underground water which has seeped underneath the foundation to be completely discharged, thus eliminating any added pressure.

The method of discharge is similar to that described in paragraph A, in which a high permeability drainage bed (including a construction filter layer, a latticed network, non-permeable PVC and a network drainage system formed by water collecting pipes) will be built under the foundation.

(4) Prevention of blockage

A. Physical feature blockage

I. A limitation of the present invention is that it is for use where the soil strata underneath the foundation has a sinking speed of the smallest soil particles that is three times greater than the seeping speed of the underground water.

II. The construction filter layer should comply with FHWA Filtration/Drainage Material Selection Specifications:

The non-woven material to be used should have the following properties:

$$O_{95} \leqq 1.8D_{85}$$

$$K(\text{non-woven material}) \geqq 10K\ (\text{soil})$$

$$O_{95} \geqq 2D_{15}$$

where $O_{95}$= opening size (in mm) in the geotextile; 95% of the openings are smaller than the given size $D_{85}$= particle size (in mm) in the geotextile; 85% of the particles are smaller than the given size B. Mineral precipitation substance blockage.

I. The physical and chemical properties of the underground water in the artificial drainage bed and the water collecting pipe network system will remain unchanged.

II. A reversed check valve should be installed in the water collecting pipe in order to provide access into the raft foundation, so as to prevent the air from going into the water collecting pipe network and the drainage latticed network bed. This further prevents $Ca^{++}$ and $Si^{++}$ ions from combining with $CO_2$ in the air to form mineral substances.

ADVANTAGES OF THE PRESENT INVENTION (1) An advantage of the present invention is that it fully makes use of the special function of the strata of earth—a force equilibrium method is usually employed in an ordinary case to solve the problem of an excessively large floating force which has occurred to the bottom plate of a raft foundation. However, the present invention allows the use of the special features of the structure of the strata of earth and the seeping principles inherent in the natural engineering of the earth.

(2) Another advantage of the present invention is that the present invention may be very rapidly constructed. The artificial filter layer, drainage bed, waterproof layer and overflow water pipe are made of high-tech materials which are light in weight and can be rapidly assembled. This is especially important when rapid construction work is required to be completed on clay, which is soft in formation. The present invention saves a great deal of construction time.

(3) A further advantage of the present invention is its reliability. By using the high-tech products described herein the porosity of the filter layer can be effectively controlled. The volume of drainage and the flow volume of the water collecting pipe ca be controlled to create a drainage bed which is more reliable than that found in nature.

(4) A still further advantage is that the strength of the floating force can be controlled. By varying the height of the height of the overflow water inlet pipe, the floating force of the water underneath the bottom plate of a raft foundation can be controlled.

BRIEF DESCRIPTION OF THE DRAWINGS

111—Water reduction structure of raft foundation bottom plate
12—Concrete layer
13—Drainage pump
14—Water level sensing control switch
15—Overflow inlet pipe
125—Mineral blockage prevention device
16—A continuous foundation wall structure body
17—A low water level line in the water tank
18—A high water level line in the water tank
19—Overflow pipe in the water collecting pool
110—Adjacent stratum of earth
114—Water level sensing converter
124—Water level indicator

21—Artificial filter bed
22—Artificial drainage bed
23—Water filter collecting pipe network
24—Artificial waterproof layer
15—Overflow inlet pipe
110—Adjacent stratum of earth

FIG. 5A illustrates the situation when the raft type of foundation bottom plate is being affected by the pressure of water. Elements illustrate include:

51—Ground water pressure line

Figure 1:
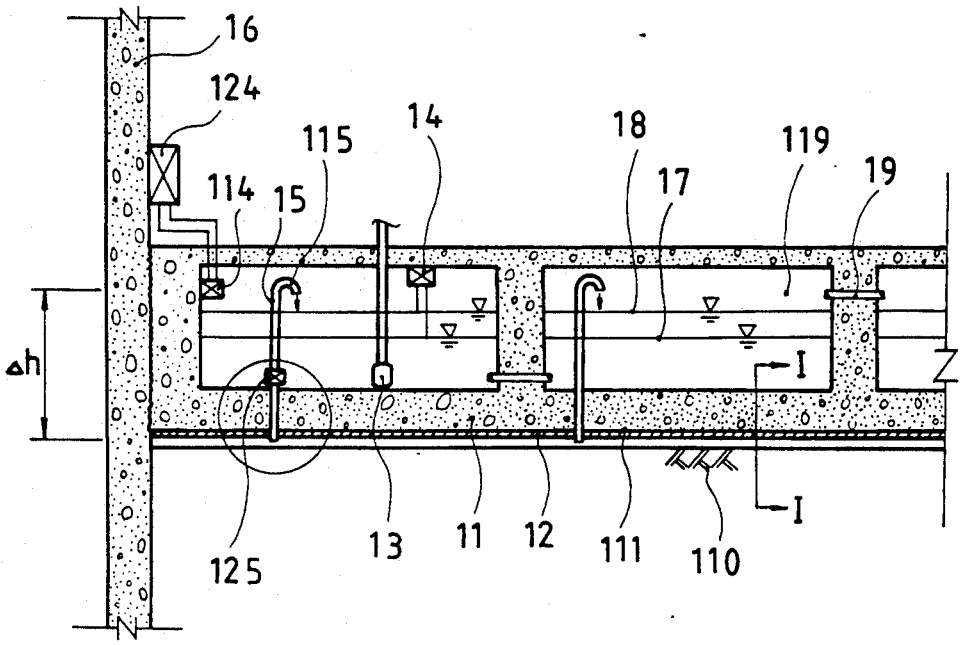
FIG. 1 is a cutaway schematic view of the present invention. Elements shown include.
Figure 1A:
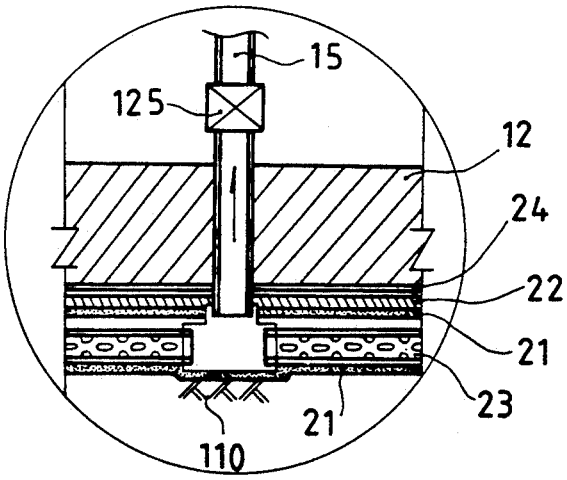
FIG. 1A is a detailed view of the area circled in FIG. 1.
Figure 2:
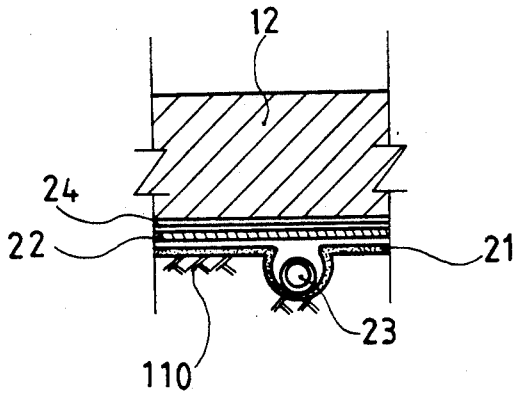
FIG. 2 is detailed cross-section of the water pressure reduction structure of the raft foundation bottom plate of the present invention. Elements illustrated include.

FIG. 5B illustrates the situation when a different foundation structure is utilized.

52—Ground water pressure line

FIG. 6A illustrates the forces acting on a foundation before installation of the present invention. Elements illustrated include:

61—Continuous foundation wall
64—The water pressure line pre-installation
62—Water pump
65—Clay stratum
63—surface of excavation FIG. 6B illustrates the situation following installation of the present invention.

61—Continuous foundation wall
52—Pump system
66—Water inlet pipe system
661—Artificial drainage bed
67—The water pressure line after installation, and after drainage
68—The water pressure line after installation, and before drainage
65—Clay stratum

DETAILED DESCRIPTION OF THE PREFERRED EMBODIMENT

The following description of the preferred embodiment of the present invention will be made with reference to FIGS. 1, 2, 3, and 4 as indicated. The procedures set forth below should be followed to maximize the effectiveness of the present invention.

1. Geological Survey—when performing a foundation survey, an on-site permeability test and indoor permeability test should be added to ascertain the coefficient of permeability underneath each of the various strata of earth. The water level should be determined by using a water level observation well. The distribution of the water pressure in the strata of earth should be measured by means of various water pressure meters, and reference drawings of the coefficient/parameter of permeability in the various strata of earth should be prepared.

2. An analysis of total, differential, and oblique settlement rates for the proposed site should be prepared. This will allow the construction to be accomplished with minimal differential settlement, and the equilibrium point can be reached quickly.

3. Oblique torque analysis—to prepare a load distribution drawing for the project to analyze the long-term stability of the overall structure, and to minimize the impact of the oblique torque on the structural body. An earthquake analysis should also be performed.

4. Determination of the insertion depth of the continuous foundation wall. The continuous foundation wall is featured for its non-permeability. When choosing its insertion depth, the depth of penetration into the non-permeable layer or low permeability layer should also be set to satisfy the following requirements:

A. The volume of water permeated into the raft foundation should be less than 1.0 $m^3$/hr.

B. The vertical water permeating speed $V_{up}$ should be less than the settlement speed $V_{down}$ of the smallest soil particle.

The main objective of this design is to reduce the volume of water to be processed as much as possible so that it is easy to drain the water with a mechanically driven pump. In this way, the pressure will be reduced very slowly, and thus will prevent permanent blockage of the permeability layer.

5. Installation of the artificial filter bed 21—when the foundation has been dug to the depth designed, a filter bed 21, which has a coefficient of permeability 100 times greater than that of the contacting soil strata, will be installed. A non-woven fabric of $K=10^0-10^{-3}$ cm/sec should be used.

The advantages of the artificial filter bed 21 are as follows:

A. Convenient construction:

The filter bed 21 will be separated from the contacting soil 110 underneath the foundation to minimize stirring the soil, so as to facilitate the working procedures which follow.

B. To assure the drainage function of the drainage bed:

It helps prevent the particles of the contacting soil from gaining access into the drainage bed 22 above the filter bed. Soil particles in the drainage bed will inevitably cause blockage or reduce the functioning of the drainage bed 22.

C. To enhance the reliability of pressure reduction in the drainage process:

To select a filter bed 21 with appropriate porosity and thickness (while complying with the requirements of $D_{15}$) not only will effectively control the volume of vertical permeability, but will also increase the volume of permeability. Thus, the overall pressure reduction function will not be affected when partial blockage occurs.

6. Installation of a drainage bed 22 on the artificial filter bed 21:

The main function of the drainage bed 22 is to form a larger pier which can be controlled, the water that has permeated the foundation can be rapidly collected and pumped out. Its coefficient of permeability is larger than 1.0 cm/sec (1–10 cm/sec is usually employed). The two following methods may be employed alternatively for the drainage bed:

A. Artificial drainage bed 22—an artificial grid network which will not decay, with a pressure resistance strength complying with the specifications required and an excellent permeability, also with a high density HDPE and a high density PVC (HPVC) or high density PE. The coefficient of permeability may range from 1–10 cm/sec., and its horizontal volume permeability Q is larger than 5.0 liter/meter/sec.

B. Natural drainage layer—a material in which the natural pore is comparatively large may be used above the artificial filter bed 21. A gravel grade of material may be used in conjunction with medium and small grade sand. The thickness of the natural drainage layer should be chosen to reach a horizontal permeability volume which is larger than 5.0 liter/meter/min. The thickness of the natural drainage layer should be determined by the gravel grade in coordination with the porosity and the permeability volume of the sandy soil layer. It will usually be 10–30 cm thick.

7. The installation of a filtered water collecting pipe network system 23—the network 23 should be installed in the artificial filter bed 21 and in the drainage bed 22. The tapping rate of collecting pipe network 23 is larger than 3.0%. The artificial filter bed 21 is made of non-woven fabric. The pipes of the collecting pipe network 23 are 1.0"–2.0" in diameter, depending on the total volume of water which permeates every day into the site. While designing the foundation, a coefficient of safety 100 times larger than the total permeability volume should be employed to avoid any possible blockage.

8. Artificial waterproof layer 24—it is made of PVC and is completely waterproof. Its main function is to prevent the concrete 12 from permeating the artificial drainage bed 22, which would reduce the effectiveness of the bed 22.

9. Overflow water inlet pipe 15—the top of the aforementioned pipe 15 is open to the atmosphere. Therefore, the height of the overflow water inlet pipe 15 which stretches from the raft foundation bottom plate 11 to the overflow opening 115 must be determined according to the following equation:

$$P_w = {}_w \times H_w.$$

where $P_w$ is the amount of the floating force; w is the unit weight of water, and $H_w$ is the height of the pipe 15, (also denoted as h)

Therefore, when the overflow water inlet pipe 15 is higher than the water level plane 18 of the raft foundation and lower than the external underground water level, the water pressure on raft foundation bottom plate 11 will be proportional to the height which of the pipe 15. When the height of overflow pipe 15 is properly chosen, the size of the floating force underneath raft foundation bottom plate 11 can be effectively controlled, thus achieving the object of reducing the pressure under raft foundation bottom plate 11 as indicated in FIG. 1.

Figure 3:
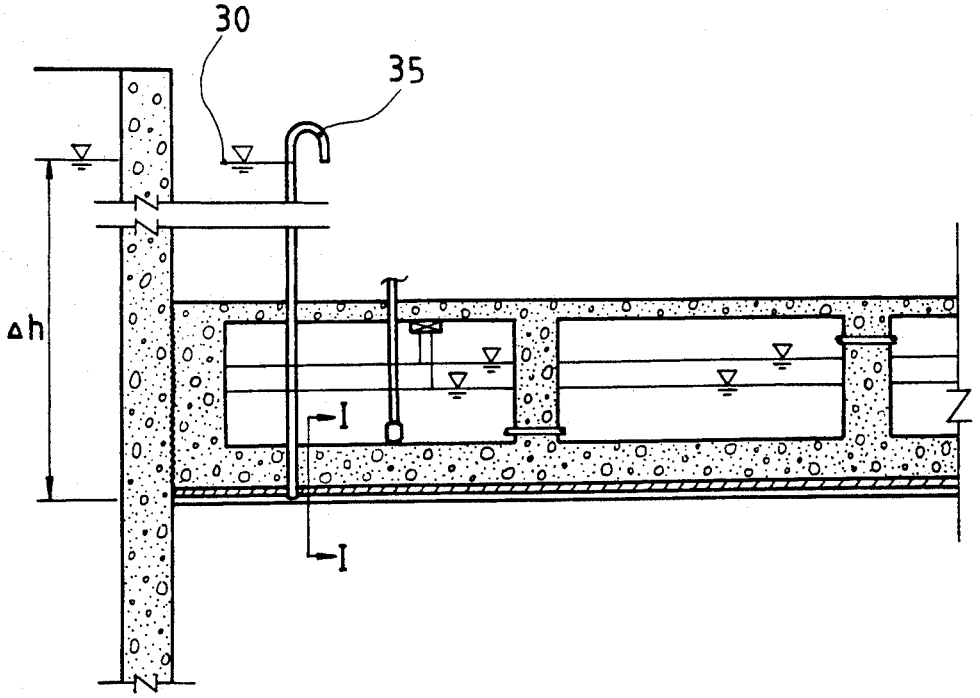
FIG. 3 illustrates the situation when water inlet pipe overflow inlet pipe 35 of the present invention is higher than the external underground water level 17.
Figure 4:
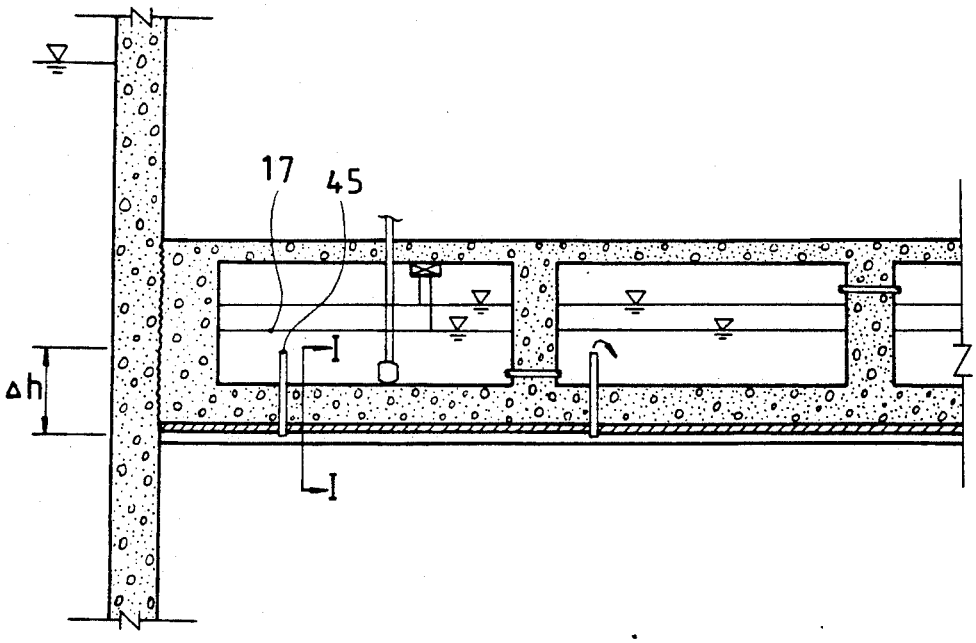
FIG. 4 is a cross-section of the present invention illustrating the situation when water inlet pipe overflow outlet 45 of the present invention is lower than the exterior highest underground pumping water level 17.

When the situation is as in FIG. 3, and the inlet pipe-/overflow inlet pipe 35 is higher than the underground water level, the floating force on raft foundation bottom plate 11 will be equivalent to the highest water floating force i.e., the water floating force of underground water level plane 30 which stretches to raft foundation bottom plate 11 as indicated in FIG. 3. When the situation is as illustrated in FIG. 4, the water inlet pipe overflow opening 45 is lower than the lowest pumping water plane 17 in the raft foundation water tank.

10. Water collecting pool dynamic force pumping system—in the dynamic drainage system, the pump 13 will, in coordination with auto water-level sensing control switch 14, drain the water which permeated through artificial filter bed 21, artificial drainage layer 22, filter water collecting pipe network system 23 and artificial waterproof layer 24 into the water collecting pool to the drain gutter outside the building. In order to enhance its reliability, this system may be designed to have two units, one for operation with the other as a backup.

11. Water collecting pool 110 overflow pipe 19—a water collecting pool is built in the raft foundation water tank of a building, the water collected therein will be drained by a dynamic force system to the drain gutter outside the building. Thus, if the pump 13 in the drainage system is out of order and the water level of the permeated water collecting pool becomes higher than design value 18, the overflow pipe 19 will be utilized to drain the water to the drain gutter outside the building.

12. The water level monitoring system within the water tank—a sensing or floating force type water-level converter 114 is set in the water collecting pool inside the raft foundation. The aforementioned water-level converter 114 will convey the water-level signal to a data collecting device or indicator 124 to generate water level position signals. When the water level is too high, alarms and lighting signals will be generated to alert people to perform necessary adjustment and maintenance. The rising speed of the permeated water collecting pool is very slow. Depending on the size of a water collecting pool, the daily rising speed is ranges from approximately 0.01 cm to 1.0 cm/day. The daily water volume which permeates into the foundation is ranges from approximately 0.5 to 20.0 cubic meter/day.

13. Mineral blockage prevention device 125—a comparatively higher concentration of $Ca^{++}$ and $Si^{++}$ ion is usually found in the permeated water in the soil strata. Such minerals will precipitate and become $CaCO_3$ and $SiCO_3$ when combined with $CO_2$ found in the air. Blockage prevention device 125 is a reversed stopper valve. The valve only allows water to flow upward through it, and will not allow air to enter the system through drain pipe 15.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. A raft foundation pressure reduction structure which is located at the bottom of a raft foundation designed to control the water pressure at a raft foundation bottom plate by making use of the characteristics of the soil strata's low permeability, the high permeability of the pressure reduction structure, and a height differential found in the overflow water inlet pipe, comprised of:

an artificial filter bed designed to assure the function of an artificial drainage layer and to prevent the particles of the contacting soil from entering and causing blockage to the artificial drainage layer; the filter bed does not affect the permeating function of the soil strata underneath and its permeability also will not be affected by blockage caused by the particles of soil;

an artificial drainage layer designed to form a comparatively more porous layer, through which permeating water will be rapidly collected to flow to an artificial water filter pipe network system;

a water collecting pipe network system installed in the artificial filter bed and in the artificial drainage layer, which enables the water which permeated through a clay layer underneath the foundation to be collected int he water filter collecting pipe network system;

an artificial waterproof layer designed to prevent concrete from permeating the artificial weatherproof layer to cause said waterproof layer to lose its permeability;

an overflow water inlet pipe device which controls the floating force of the raft foundation, so designed that when the height between an opening of the water overflow inlet pipe and the raft foundation bottom plate is higher than the highest water level plane in the raft foundation water tank and lower than the underground water level plane in the exterior of a continuous foundation wall, by means of a water volume Q1 which permeated into the drainage layer underneath the raft foundation and a water volume Q2 which flows into the overflow water inlet pipe;

a mineral blockage prevention device, in which a reversed stopper valve int he pipeline system will be employed to allow the water to flow upward only, so as to prevent air from entering into the water filter/collecting network system and causing blockage as a result of mineral sedimentation.

* * * * *